United States Patent [19]

Treiber

[11] Patent Number: 5,020,305

[45] Date of Patent: Jun. 4, 1991

[54] PACKAGE PLATTERING DEVICE AND METHOD

[75] Inventor: Fritz F. Treiber, Centerville, Ohio

[73] Assignee: Hobart Corporation, Troy, Ohio

[21] Appl. No.: 525,790

[22] Filed: May 18, 1990

[51] Int. Cl.[5] ..... B65B 57/12; B65B 35/56

[52] U.S. Cl. ..... 53/500; 53/244; 53/505; 53/534; 198/418.9; 414/798.2; 414/799

[58] Field of Search ..... 53/505, 55, 251, 534, 53/244, 255, 259, 498, 495, 500; 198/418.9, 431; 414/799, 798.2, 798.5

[56] References Cited

U.S. PATENT DOCUMENTS

| | | | |
|---|---|---|---|
| 2,542,330 | 2/1951 | Henderson et al. | 414/799 X |
| 2,844,926 | 7/1958 | Mattos | 53/534 |
| 3,225,513 | 12/1965 | Ehe | 53/244 X |
| 3,470,674 | 10/1969 | Madonia | 53/534 X |
| 4,238,024 | 12/1980 | Hirakawa et al. | 198/418.9 |
| 4,809,575 | 3/1989 | Swanson | 53/55 X |
| 4,944,135 | 7/1990 | Treiber | 53/441 X |
| 4,945,825 | 8/1990 | Florindez | 198/431 X |

FOREIGN PATENT DOCUMENTS

| | | | |
|---|---|---|---|
| 2711049 | 9/1978 | Fed. Rep. of Germany | 53/534 |
| 2480235 | 10/1981 | France | 53/534 |

*Primary Examiner*—James F. Coan

*Attorney, Agent, or Firm*—William Weigl; Russell L. McIlwain

[57] ABSTRACT

Automatic package shingling device deposits packages exiting from an end of a package conveyor onto an elongated platter moving in coordination with package movement below the package conveyor. Controls are provided to arrest package feed when a first platter is filled, until such time as a second, empty platter is placed into package-receiving position.

13 Claims, 3 Drawing Sheets

FIG. 1
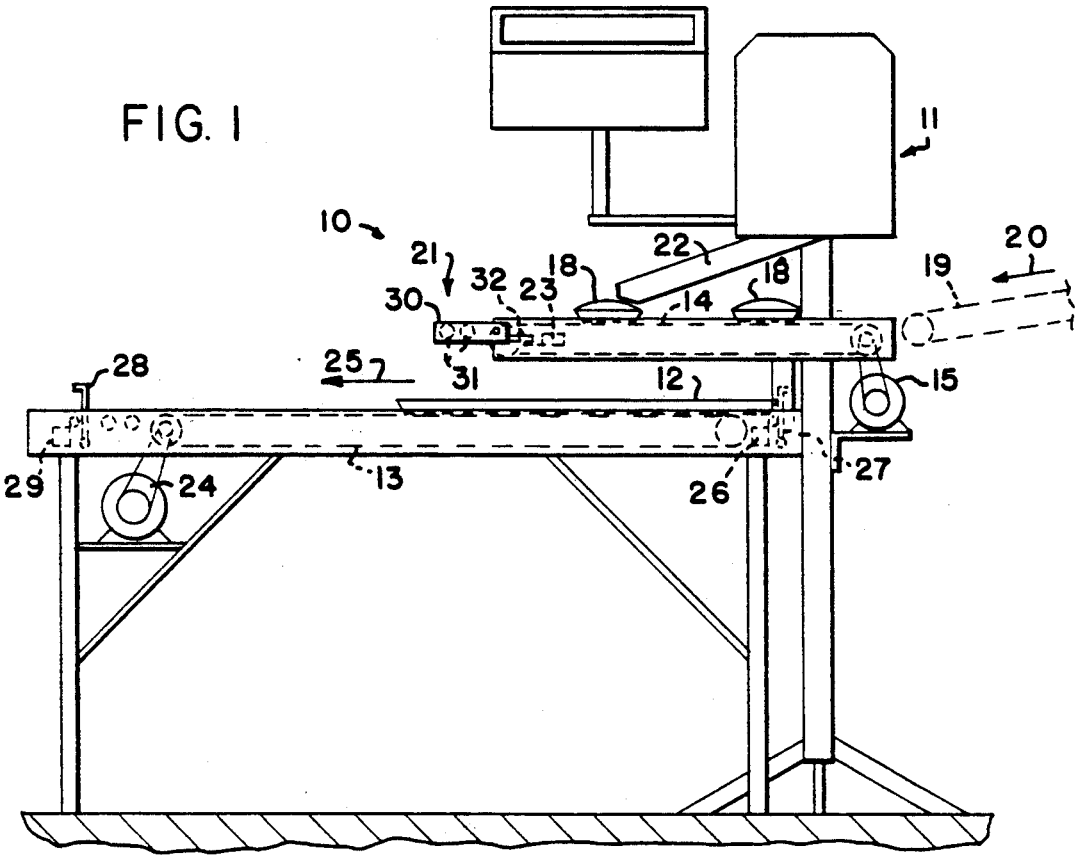
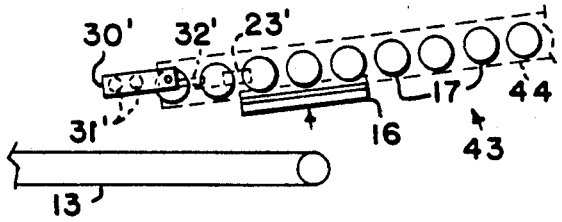
FIG. 3

PACKAGE PLATTERING DEVICE AND METHOD

This invention relates primarily to a method and means for automatically shingling weighed, wrapped and labeled packages onto an elongated platter to enable their transfer in batches from a labeling station to a produce display location such as a meat case of a supermarket.

BACKGROUND OF THE INVENTION

Packages of meat or produce are generally wrapped in a transparent wrap and labeled after weighing. Upon completion of labeling, they drop from a conveyor into a rotary package-collecting bin. If the package contains red meat with some liquid blood at the bottom of the tray, and if that package flips over as it drops into the bin, the blood may run to the transparent top of the wrapped package and the package may appear unsightly when displayed for sale. In addition, corners of the packages are sometimes damaged from the drop.

One version of apparatus including a bin is shown in U.S. Pat. No. 3,907,627 issued in my name on Sept. 23, 1975. Packages are retrieved from the filled bin, hand-stacked into platters, and the platters either hand or cart-carried to the display area for customer selection. This handling is often done by some of the more high-priced help, such as butchers who function in the meat room of the supermarket, where a large percentage of wrapping and labeling is done. The cost of using a butcher for hand labor tasks not only increases the cost of operation of the supermarket, but also takes the butcher's time away from cutting meat. Productivity is thus hampered by the inefficient use of higher cost labor, especially when wrapping and labeling is required during peak shopping periods. The reduced productivity and added labor cost resulting from the hand removal of packages from a bin and transfer to platters has long been recognized, but little attention has been given to the problem, or if it has, no satisfactory solution has been found. Supermarkets continue to operate much the same way as they have for many years.

SUMMARY OF THE INVENTION

This invention is intended to overcome the problems inherent in delivering finished packages from an automatic wrapping machine or hand wrapping station. It is accomplished by moving an elongated platter in conjunction with movement of packages along a conveyor, and shingling the packages on the platter after labeling to maximize usage of space along the length of the platter. After shingling, the platter with its trayed and wrapped packages can then be manually lifted and taken to a location where the packages are displayed for customer sales. Ordinarily, a multi-shelved cart and a number of empty platters are provided alongside the plattering station. As one platter is filled, it is placed on a shelf of the cart and is then replaced in the device by an empty platter. In this fashion, especially if the wrapping operation is mechanized through use of a wrapping machine such as shown in my U.S. Pat. No. 4,513,558, issued Apr. 30, 1985, a large run of trayed meats or produce can be handled by a machine operator and an assistant. The trays which had been used to carry trayed products to the wrapping machine for wrapping can also be used for receiving the shingled packages at the exit end of the line. Such material flow and usage of trays provides for better overall handling of products at a faster pace, resulting in a simpler and more efficient, less time-consuming and thus an overall less-costly operation.

This invention finds its most practical use in a food supermarket, wherein packages of meat or produce are displayed for view and selection by consumers in clear stretch wrap film which has been placed around each package. Products are first placed on individual cardboard, plastic or foam trays and a sheet of stretch film applied either by a machine such as shown in the aforementioned U.S. Pat. No. 4,513,558 or at a handwrap station such as the one illustrated in U.S. Pat. No. 3,579,949 issued to Michels on May 25, 1971. Wrapped packages typically carry labels which are applied as the last step in a weighing, wrapping and labeling operation, with weighing occurring either before or after wrapping.

In an automatic wrapping system, platters of unwrapped, trayed produce are supported on shelves of a mobile cart, and the cart is rolled alongside an infeed portion of the machine. An operator then feeds the produce by hand, one tray at a time, into the machine. The machine automatically pulls film from a roll, cuts it into a sheet and applies the sheet around the package with the front, rear and sides of the sheet tucked beneath the package. The bottom of the wrapped package is then heat-sealed. After wrapping and sealing, the package is conveyed to a location at which it is weighed. Thereafter, a pricing label providing customer information regarding the weight, the price per unit of weight and the total value of the package is added to each individual package. A recent innovation in the supermarket meat packaging industry is the addition of a merchandising labeler for applying a second (typically an eye-appealing fluorescent) merchandising label to each package after the pricing label has been applied. Such a merchandising labeler is shown in U.S. Pat. No. 4,857,121 issued to Richard L. Markley et al on Aug. 15, 1989. It will not be further described herein, since it is merely illustrative of various types of devices with which my plattering device is capable of being used.

In addition to operation in connection with automatic wrapping machinery, the plattering device and method may be employed for handling packages that are individually hand-wrapped and fed into the plattering device. The packages, while preferably weighed and labeled, need not be. For example, the packages may be wrapped at a central location of a supermarket chain, delivered to different chain stores, and weighed and labeled there. A main difference between an automatic and hand-wrapping operation is that the spacing between the packages will ordinarily be constant in an automatic operation, whereas the spacing will vary from package to package in a hand-wrapping operation depending on operator efficiency and skill. The system about to be described is capable of handling all sorts and sizes of packages, regardless of any difference or irregularity in the spacing between the packages, and even whether successive packages are of different sizes. In some instances, the packages may even contain different products. The device can handle a full range of tray lengths (the distance from the lead of each tray to its trailing edge, as measured in the direction of package travel) providing that the tray length and width are within a range accommodated by the machine or can be handled readily in a hand-wrapping operation.

BRIEF DESCRIPTION OF THE DRAWINGS

FIG. 1 is a simplified elevational side view of one embodiment of a plattering device located at the output end of a packaging system, in which packages are moved along a package conveyor, labeled and shingled onto a platter carried on and movable along a platter conveyor which is intermittently operated in coordination with exit of packages from the package conveyor.

FIG. 3 illustrates a portion of a second embodiment similar in function to the FIG. 1 embodiment, but in which a gravity-fed package conveyor is utilized instead of the motorized package conveyor.

DESCRIPTION OF THE PREFERRED EMBODIMENTS

Figure 2:
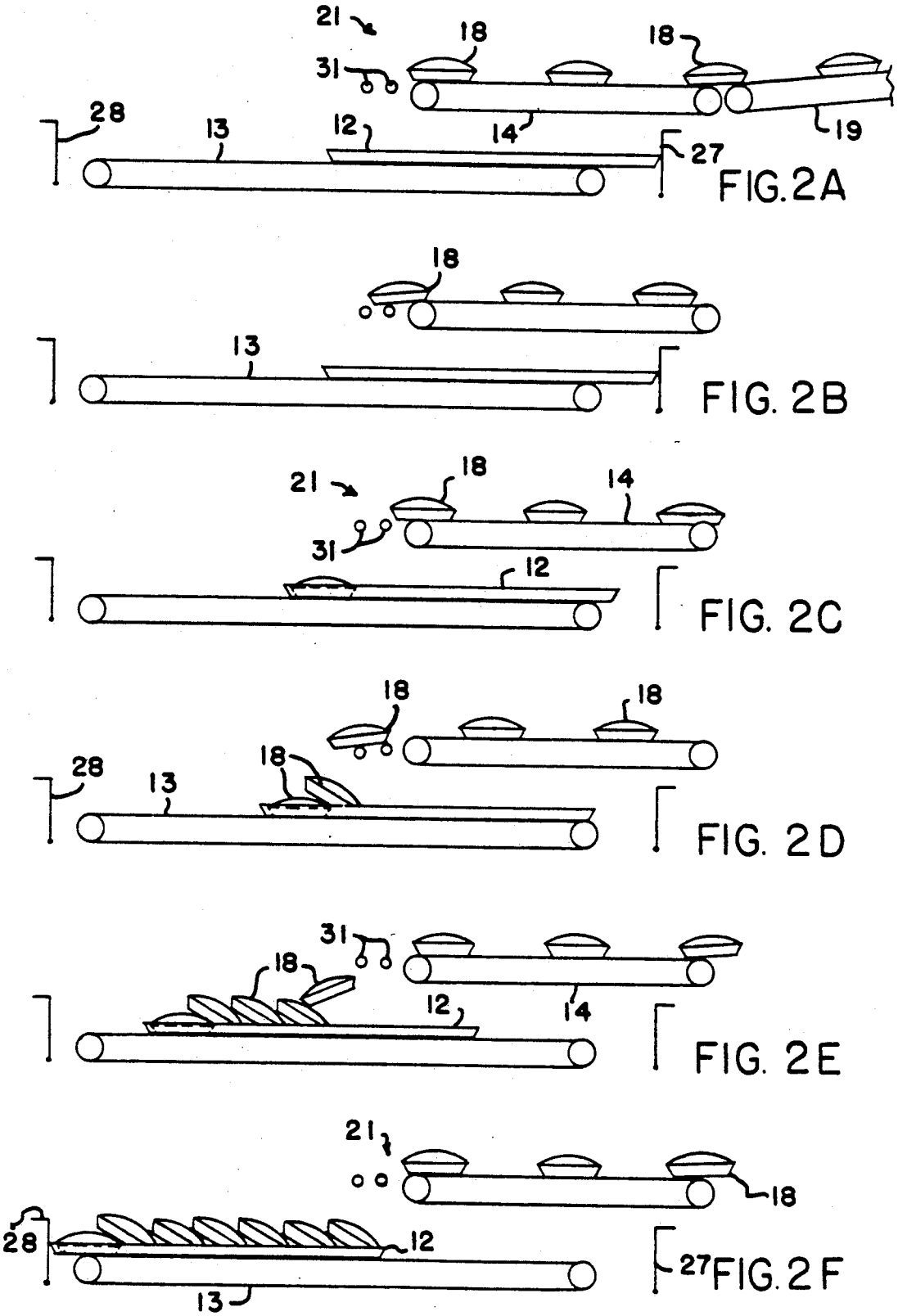
FIGS. 2A–2F are schematic illustrations of the system of FIG. 1, comprising steps to illustrate packages moving along the package conveyor and being deposited onto a platter in shingled fashion.

A plattering device 10 is illustrated with a merchandising labeler 11 positioned along conveying means to add eye-appealing labels to packages as they are conveyed to an elongated platter 12. As will be seen, the platter 12 is conveyed intermittently along a platter conveyor 13 to receive packages as they drop in controlled fashion from the end of a package conveyor 14.

The feed and speed of an elongated platter 12 along its conveyor 13 is coordinated with package feed to the platter by providing for sensing of package position as each package exits from a package conveyor 14. Arresting of the package conveyor 14 is also provided for when a platter has been filled, must be removed and replaced with a second, empty platter. During stoppage, either by discontinuing driving the package conveyor by a motor 15 as shown in the FIG. 1 embodiment or by applying a brake pad 16 to rollers 17 as shown in the FIG. 3 embodiment, the closing of gaps between packages has no effect on the plattering operation. There can be, however, a possibility of system back-up due to a prolonged delay in removing a full platter 12 and replacing it with an empty platter. Obviously, operator attention must be given to the system, particularly in the case of use with an wrapping automatic machine. It would not make sense to continue feeding trayed products into the wrapping machine if delay in platter removal or replacement occurred at the plattering device 10. If desired, an interlock may be provided to stop the wrapping machine automatically when a platter is filled or a back-up of packages occurs at a crucial part of the system.

The large variety of equipment with which the plattering device 10 may be used is known in the supermarket industry. Since such potential uses will become apparent to persons knowledgeable in this art upon review of this disclosure, they may be alluded to but not discussed in detail herein. Merely as one use illustration, for example, where meat is intended to be sold by a specific date after packaging, unsold packages remaining in the meat case toward the end of the expiration date may be removed, placed on a platter and returned to the meat room. There they can be hand-fed into the system upstream of the merchandising labeler 11 and new merchandising labels applied. The new labels may be applied over the old and may read something such as "HALF-PRICE". The relabeled packages are replattered by the device 10 and taken back to a "Special Sale" meat case.

Referring now in greater detail to the schematic showing in FIG. 1, packages 18 are successively fed along a package conveyor 14, preferably having been received from an inlet conveyor 19. Conveyor 19 may receive packages 18 directly from an automatic wrapping machine (not shown) or from an indexer-label applier (not shown), the latter of which is commonly referred to in the supermarket trade as an ILA. The ILA may be intermediate the automatic wrapping machine and the plattering device 10 or it may be a stand-alone unit for receipt of hand-wrapped packages which may be prepared in accordance with the teaching of the aforementioned U.S. Pat. No. 3,579,947. It is common for an ILA to include a weighing station and a station for applying a pricing label. What particular mechanisms or machines precede the plattering device 10 is immaterial, it being understood that packages 18 traveling along inlet conveyor 19 in the direction of arrow 20 are transferred to the package conveyor 14 and then dropped at its output or exit end 21 onto a platter 12 which is intermittently driven along platter conveyor 13 in coordination with package delivery to the platter. The lead package 18 of the two shown in FIG. 1 is shown as having a merchandising label applied by a labeling arm 22 of the merchandising labeler 11 in accordance with the disclosure of the aforementioned U.S. Pat. No. 4,857,121.

A package 18 reaching the exit end 21 of conveyor 14 as shown in FIG. 1 will cause a sensing means shown herein as a normally-open switch 23 to cause commencement of driving the conveyor 13 by a motor 24 so that platter 12 is driven in the direction of arrow 25 during the time switch 23 is closed. Preferably, motor 24 runs continuously and is provided with both a clutch and a brake, one or the other of which is applied to selectively drive or stop the belt of the conveyor 13 in accordance to the timing of packages exiting onto the platter 12 or not, respectively.

Also shown in FIG. 1, a normally-closed load switch 26 is adapted to be operated by a pivotable load lever 27. Lever 27 is spring-biased leftwardly to enable switch 26 to remain closed except at a time when a platter 12 has moved load lever 27 against its leftward bias. Rightward movement of lever 27 by a platter 12 causes switch 26 to open. At the opposite end of the platter conveyor 13, a similar spring-biased unload lever 28 functions to control a normally-open unload switch 29 to function to discontinue feeding of packages when a full platter 12 has received an array of shingled packages and the platter pushes against the lever 28. As will be discussed in greater detail in connection with the wiring diagrams of FIGS. 4 and 5, package conveyor motor 15 will not start up the package conveyor 14 upon removal of a filled platter. Only when an empty platter is placed in the position illustrated in FIG. 1 to move the lever 27 rightwardly can the system again start functioning to automatically platter packages.

Switch 23 may be referred to hereinafter as the package trip switch. It is actuated to close when a pair of pivotal, upwardly-biased arms 30 which journal one or more rollers 31 just beyond the leftward end of the belt of conveyor 14 pivot downwardly as a package contacts the rollers 31. One of the arms 30 carries an extension 32 (shown in dotted lines) used to actuate the package trip switch 23 when a package arrives on the rollers 31. Bias of the arms 30 is upwardly about a pivot point between extension 32 and rollers 31. When no package 18 is present or resting on rollers 31, a brake is applied to the drive for conveyor 13 even though motor 24 operates continuously whenever the system is in the on state. When the arms 30 pivot downwardly in response to a package reaching the exit end 21 of the package conveyor 14, the extension 32 enables the normally-open trip switch 23 to close, disconnecting the brake and also energizing the clutch to provide for physical driving of the belt of the conveyor 13 in response to the driving of the motor 24.

The relative speeds of the belts of conveyors 13 and 14 are arranged so that the platter 12 moves at a high enough rate to allow for maintenance of a space between successive packages 18. Cross-referring to steps 2A–2F of FIG. 2 and the wiring diagram of FIG. 4, let us now assume that the plattering device 10 is connected to operate in conjunction with an automatic wrapping machine. At start up, the wrapping machine will be "powered up" in conventional fashion, and the plattering device 10 will likewise be powered by closing of a master switch 33. At the time switch 33 is closed, and providing no platter 12 has yet been placed in position on conveyor 13, motor 15 for driving belt conveyor 14 will be energized by virtue of normally-closed contacts 34 of a relay 35 being in their closed condition. This provides 120 volts A.C. to motor 15. A platter 12 is then placed in the position of FIG. 1 and is moved to urge lever 27 rightwardly against its spring bias. Although this causes switch 26 to open, the opening has no affect at initial start up. The primary function of load switch 26 is to interrupt feed of packages 18 along conveyor 14 after the first platter 12 has been filled with packages, and maintain conveyor 14 inactive until a second platter 12 is placed in position to receive packages. Opening of switch 26 by the second platter restores power to motor 15 through the re-closing of contacts 34 of relay 35, which had been energized when the first platter reached lever 28. Thus, switch 26 acts to hold relay 35 energized until a new, empty platter has been placed into package-receiving position.

Figure 4:
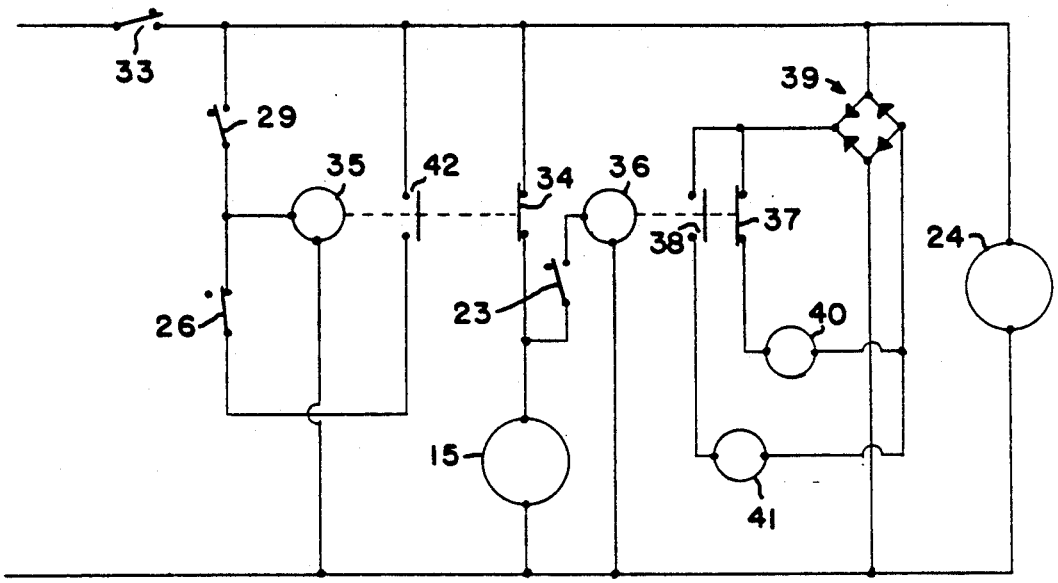
FIG. 4 is a schematic wiring diagram of an electrical control circuit which may be utilized in conjunction with the embodiment of the invention disclosed in FIG. 1.

Step 2A shows a lead package arriving at exit end 21 and about to enter onto rollers 31. Step 2B shows the rollers 31 just as they are pivoted downwardly to sense that package 18 is ready to be deposited in the platter 12. At this time the extension 32 causes the normally-open package trip switch 23 to be closed. FIG. 4 illustrates that closing of switch 23 energizes relay 36, opening its normally-closed contacts 37 and closing its normally-open contacts 38. Contacts 37 and 38 function in connection with a conventional bridge circuit 39 to control an electrically-operated brake 40 and an electrically-operated clutch 41, respectively. The brake 40 and clutch 41 work in conjunction with continuous running motor 24 in conventional fashion. Energization of the brake 40 holds the belts of conveyor 13 stationary while deenergization of the brake 40 and engaging the clutch 41 will drive the belt of conveyor 13. Drive continues as long as a package contacts the rollers 31, to indicate the presence of the package at the exit end 21 of the plattering device. As soon as the package drops off rollers 31 (such as has just been completed at step 2C), the rollers 31 return upwardly, opening switch 23, deenergizing relay 36, opening contacts 38 and closing contacts 37. Clutch 41 will drop out upon opening of contacts 38 and brake 40 is reapplied to stop the conveyor 13 as a result of closing of contacts 37.

Immediately upon switch 23 being energized and starting to drive the conveyor 13, the platter 12 moved away from load lever 27. At that time load switch 26 was restored to its normally-closed condition as shown in FIG. 4. This readies the system for continuous operation of replacing filled platters with new empty platters.

Step 2D shows a third package 18 on rollers 31 and two packages already in platter 12. Conveyor 13 is running at this particular time since a package 18 is on rollers 31, but will stop promptly when the package has its trailing end drop off the rollers 31 as illustrated in step 2E. At that time, upward biasing of rollers 31 will open the package trip switch 23 and the brake will be applied to the conveyor 13 to arrest platter movement until the next signal to move is received.

When platter 12 has been filled and the last package placed thereon as illustrated in step 2F, it is necessary to stop conveyor 14 from further feeding of packages to exit end 21, even though the automatic wrapping machine may continue running 19. As the platter 12 reaches the position of step 2F, unload lever 28 is biased leftwardly, causing closing of switch 29 to shut down operation of conveyor 14 by turning off motor 15. This is accomplished by closing of switch 29 effecting energization of relay 35, opening its contacts 34 (which are in series with motor 15) and simultaneously closing its normally-open contacts 42. The now-closed contacts 42 are in series with the normally-closed load switch 26 to provide a hold-in circuit for relay 35 to maintain relay 35 energized when contacts 29 are reopened upon removal of the filled platter from the conveyor 13. Since package conveyor 14 is stationary at this time, the packages 18 thereon will maintain their spaced relationship until conveyor 14 is again driven in response to operation of motor 15. As soon as a filled platter is removed from conveyor 13, a second, empty platter 12 is placed in the position of step 2A, causing load lever 27 to open the normally-closed switch 26, breaking the hold-in circuit provided through contacts 42 and switch 26. Breaking the hold-in circuit deenergizes relay 35. Deenergization of relay 35 restores contacts 34 to their normally-closed position, again starting motor 15 and enabling switch 23 to be intermittently closed as each package reaches the exit end 21 ready for deposition onto a second platter. This sequence of operation will continue until such time as the automatic wrapping machine has completed its run of trayed products to be wrapped, weighed and labeled, and the wrapping machine is turned off or automatically shuts down. Such wrapping machine is ordinarily set to continue running for several machine cycles after the last trayed product which was fed thereinto has passed out of the wrapping machine. The plattering device 10 can be turned off after the last package 18 has been placed on a platter 12, by opening master switch 33.

In FIG. 3, I illustrate a further embodiment of my invention which, in some instances, is most suitable for use in conjunction with a hand-wrapping operation and an ILA. Several elements and electrical controls of FIGS. 3 and 5 have been similarly numbered with a prime (') mark to illustrate the same or similar functions. Not all parts so numbered will be described, even though numbers have been applied to show sameness.

In hand-wrapping, the spacing between successive packages can vary depending upon the time taken to wrap each package and any interruptions that might occur during the hand-wrapping. In FIG. 3, a package conveyor 43 replaces the motor driven belt conveyor 14. It consists of the freely-rotatable rollers 17 supported in side rails 44, one of which has arms 30' supporting rollers 31'. An extension 32' operates a package trip switch 23'.

Figure 5:
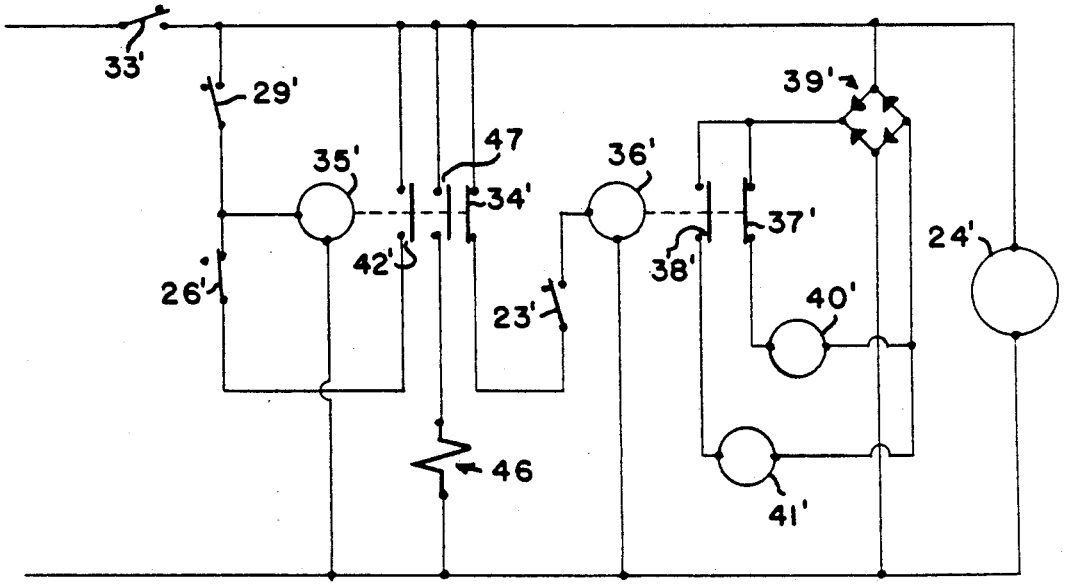
FIG. 5 is a schematic wiring diagram of an electric control circuit which may be utilized with a gravity-type package conveyor such as is illustrated in the FIG. 3 embodiment.

Because conveyor 43 allows for gravity-feed of packages as contrasted to the motor feed of the FIG. 1 embodiment, it is necessary to overcome the gravity-feed when a filled platter is to be replaced with an empty platter. This is done by applying the large brake pad 16 to certain of the rollers 17. The brake pad 16 is mechanically-operated in response to energizing an electrical brake solenoid 46 as shown in FIG. 5. The brake 16 is shown in solid lines in a non-braking condition and in dotted lines when the brake has been applied to three of the rollers 17 in FIG. 3. Braking frictionally stops any package resting on those rollers which have been braked and acts to stop any additional packages rightwardly of the braked package.

FIG. 5 shows the solenoid 46 and its normally-open contacts 47. These are the main additions to the circuit diagram over that illustrated in FIG. 4. Essentially, the brake solenoid 46 replaces the motor 15 of FIG. 4 so that when relay 35' is energized, contacts 47 will close and cause the braking effect on certain of the rollers 17. Then, when a new platter is placed in position contacts 26' will open to cause the hold-in circuit through contacts 42' and switch 26' to restore relay 35' to the deenergized state, causing brake solenoid 46 to also be deenergized as its contacts 47 open. This allows free rotation of the previously-braked rollers 17 and operation of the conveyor 13.

The apparatus and method disclosed herein are illustrative only, it being understood that variations may be made within the spirit and scope of the claims and that such are encompassed within the teaching of my invention. The switch and roller package sensing means may be of any common type, including photo-cell or other detectors. Also, instead of using the brake 40 and clutch 41, the motor 24 may be of a type suitable for quick and accurate response to operation of whatever sensing means is employed to detect packages exiting from the package conveyor. The system may include an audible or visual warning to the operator that a platter is full.

Having described my invention, I claim:

1. A device for linearly shingling trayed, wrapped packages in an elongated platter, comprising:

a platter conveyor for intermittently moving a platter lengthwise in an essentially horizontal plane from a first, empty position to a second, loaded position, drive means for said platter conveyor, a package conveyor above and having at least its output end aligned with said platter conveyor for feeding packages individually off the output end thereof and lowering them by gravity onto a platter as it is moving along the platter conveyor, the output end being adjacent to and spaced a short distance above a leading end of an empty platter in said first, empty position, sensor means adjacent said output end and activated by the presence of a package at the output end of the package conveyor, and means responsive to activation of said sensor means to operate said drive means to initiate movement of said platter conveyor at a given delivery speed upon the sensor means being activated by a package and to interrupt movement essentially when the sensed package has passed beyond said sensor means, contact of one package with any previously-deposited package arresting movement of said one package and permitting it to settle against the previous package in shingled, stacked fashion.

2. A device according to claim 1 wherein said sensor means comprises a package-actuated roller means at the end of the package conveyor and wherein means at the end of the package conveyor is provided for mounting said roller means for pivoting from an upwardly-biased first position to a lower second position against said bias upon contact by a package, and remains in said second position until the package has been discharged off said package conveyor, said first and second positions corresponding to the interrupt and initiate conditions of said sensor means, respectively.

3. A device according to claim 1 wherein said package conveyor includes a driven belt and means for driving said belt in a direction to discharge packages toward its output end.

4. A device according to claim 3 wherein said package conveyor is connected to the output end of a package wrapping machine and is driven at a speed at least as great as the output speed of the package wrapping machine.

5. A device according to claim 1 wherein said package conveyor is sloped downwardly at a shallow grade and comprises roller means enabling gradual package descent toward the output end.

6. A device according to claim 1 wherein a second sensor means is provided along said platter conveyor to detect that a platter has been filled with packages and should be removed and replaced with an empty platter, and wherein means is provided to interrupt package feed along said package conveyor in response to sensing by said platter conveyor sensor that the platter has been filled.

7. A device according to claim 6 wherein said platter conveyor sensor means comprises a trip switch actuated by the forward end of a filled platter.

8. A device according to claim 7 wherein a second trip switch is provided along the platter conveyor to be activated by a second, empty platter which has been placed into position to receive packages after a filled platter has been removed, said second trip switch reenabling driving of said platter conveyor in response to feed of packages from the output end of the package conveyor.

9. A method of automatically stacking packages in shingled fashion on an elongated platter, comprising the steps of:

moving spaced packages along a first, upper path toward an output end of a conveyor, moving a platter in the same general direction along a second path below the first path and below but closely adjacent the output end of the conveyor, sensing each package as it arrives at said output end, intermittently moving said platter along its path at a preselected speed to receive packages on said platter as they are discharged at the output end, and discontinuing platter movement as each package leaves its conveyor.

10. A method according to claim 9 wherein the packages are randomly fed with uneven spacing between packages along said first path.

11. A method according to claim 10 wherein the length of packages in the direction of feed may vary from package to package.

12. A method according to claim 9 wherein the lead edges of packages are essentially evenly spaced along said first path, but the open space between packages may vary in distance.

13. A method according to claim 9 including the additional step of arresting both package and platter movement upon completion of filling a platter, and further including the step of reenabling feeding of packages to a second, empty platter after a filled first platter has been removed from said second path.

* * * * *